US005909851A

United States Patent [19]

Fujimoto

[11] Patent Number: 5,909,851

[45] **Date of Patent: *Jun. 8, 1999**

[54] ATTACHING EQUIPMENT FOR DETACHABLY ENGAGING A STRING-TYPE OBJECT

[75] Inventor: Takuya Fujimoto, Osaka, Japan

[73] Assignee: Cat Eye Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/611,066

[22] Filed: Mar. 5, 1996

[30] Foreign Application Priority Data

Mar. 8, 1995 [JP] Japan ..... 7-048073

[51] Int. Cl.[6] ..... A44B 11/25

[52] U.S. Cl. ..... 24/196; 24/171; 362/105

[58] Field of Search ..... 24/194, 171, 181, 24/196, 197, 190; 362/105, 106

[56] References Cited

U.S. PATENT DOCUMENTS

| | | | |
|---|---|---|---|
| 390,432 | 10/1888 | Arndt | 24/190 |
| 983,718 | 2/1911 | Humphrey | 24/194 |
| 1,333,302 | 3/1920 | Froehlich | 362/105 |
| 3,069,538 | 12/1962 | Hobson | 362/105 |
| 3,404,436 | 10/1968 | McMurray . | |
| 3,601,595 | 8/1971 | Kivela . | |
| 4,035,877 | 7/1977 | Brownson et al. | 24/196 X |
| 4,131,976 | 1/1979 | Bengtsson | 24/196 |
| 5,170,539 | 12/1992 | Lundstedt et al. | 24/194 X |
| 5,471,714 | 12/1995 | Olson | 24/171 |

FOREIGN PATENT DOCUMENTS

| | | | |
|---|---|---|---|
| 664887 | 4/1929 | France | 362/105 |

*Primary Examiner*—Peter M. Cuomo
*Assistant Examiner*—Hanh V. Tran
*Attorney, Agent, or Firm*—Olson & Hierl, Ltd.

[57] ABSTRACT

An attaching equipment consists of a bracket and a spacer which is slidable in bracket. When a band formed of an elastic body is inserted through band inserting slit of bracket and band inserting slit of spacer and the band is let off, spacer moves because of the tension of band, whereby blade-like portions formed at end portions of band inserting slits pinch the band, preventing falling of the band out of the band inserting slits. When a force is applied to spacer so as to align band inserting slits and with each other, band is allowed to freely move in band inserting slits.

7 Claims, 4 Drawing Sheets

ATTACHING EQUIPMENT FOR DETACHABLY ENGAGING A STRING-TYPE OBJECT

BACKGROUND OF THE INVENTION

1. Field of the Invention

The present invention relates to an attaching equipment, and more particularly, to an attaching equipment for detachably engaging a string-type object.

2. Description of the Background Art

An attachment fitting for engaging a string-type object such as a band has been known.

However, conventional attachment fitting suffers from a problem that it takes time and labor to attach/detach the band and to adjust position of the band.

SUMMARY OF THE INVENTION

The present invention was made to solve such a problem and its object is to provide an attaching equipment which allows easy attachment/detachment and position adjustment.

The attaching equipment for detachably engaging a string-type object in accordance with the present invention includes a first attachment part having a first slit allowing insertion and passage of the string-type object therethrough, and a second attachment part slidably engaging with the first attachment part and having a second slit aligned with the first slit at a prescribed engaging position, allowing insertion and passage of the string-type object therethrough, wherein the state of engagement of the first and second attachment parts changes by virtue of a shape of at least one of the first and second slits when the string-type object moves in a direction to be drawn out from the first and second slits, so that the first and second slit become less aligned with each other.

By the attaching equipment in accordance with the present invention, attachment/detachment and position adjustment of the string-type object can be readily performed without much time and labor.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Figure 4:
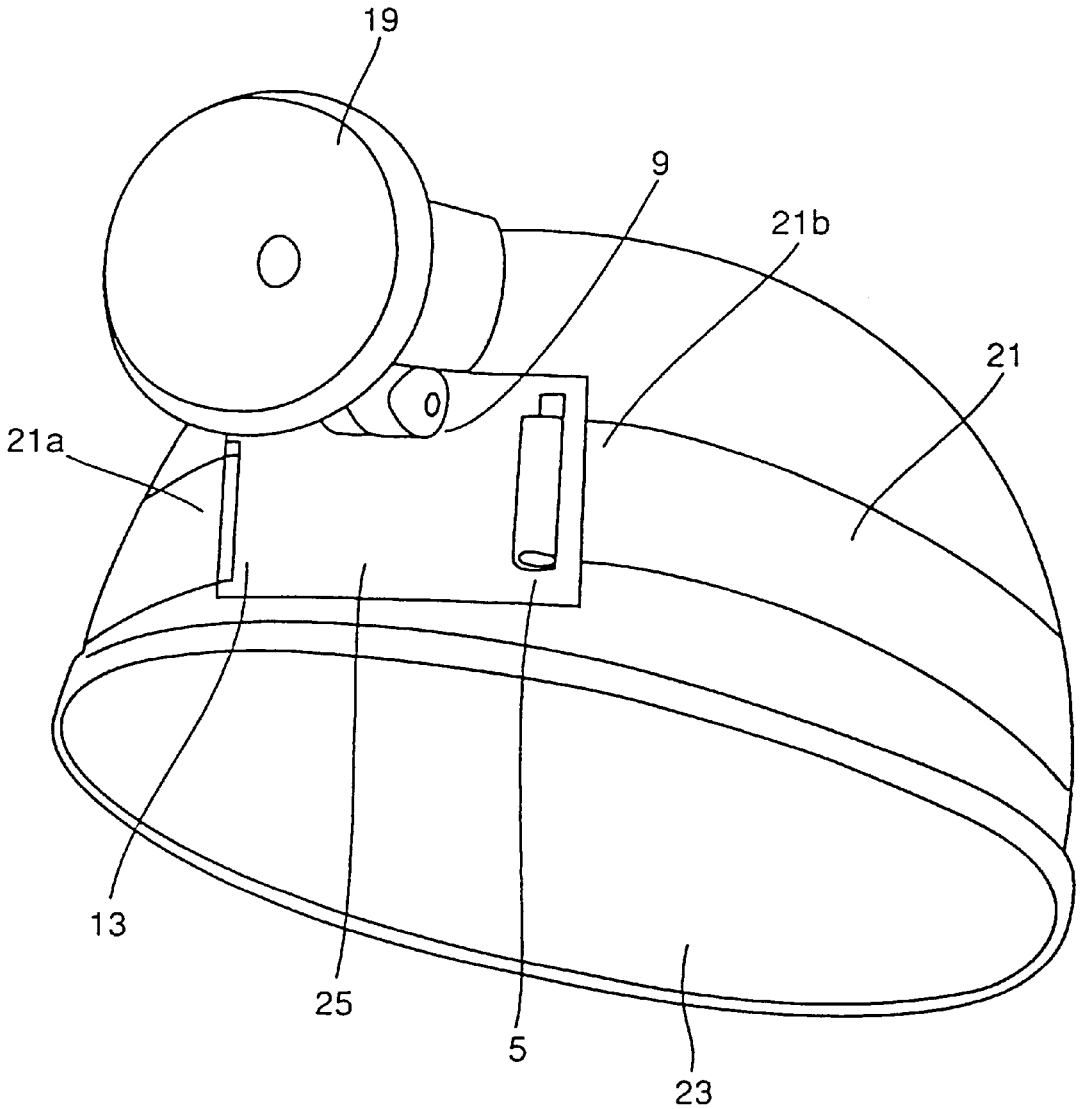
FIG. 4 shows an example of an object to be supported attached by means of the attaching equipment in accordance with one embodiment of the present invention.

FIG. 4 shows a helmet 23 around which a band 21 formed of an elastic body such as an elastic braid is attached by means of the attaching equipment 25 in accordance with one embodiment of the present invention, with a head lamp 19 further attached on the attaching equipment 25.

Referring to the figure, first end 21*a* of band 21 is engaged with a band engaging portion 13 of attaching equipment 25. Band 21 is wrapped around helmet 23 and the second end 21*b* is engaged with band inserting slit 5 of attaching equipment 25.

Head lamp 19 is mounted by means of a screw, at an object engaging portion 9 of attaching equipment 25.

Figure 1:
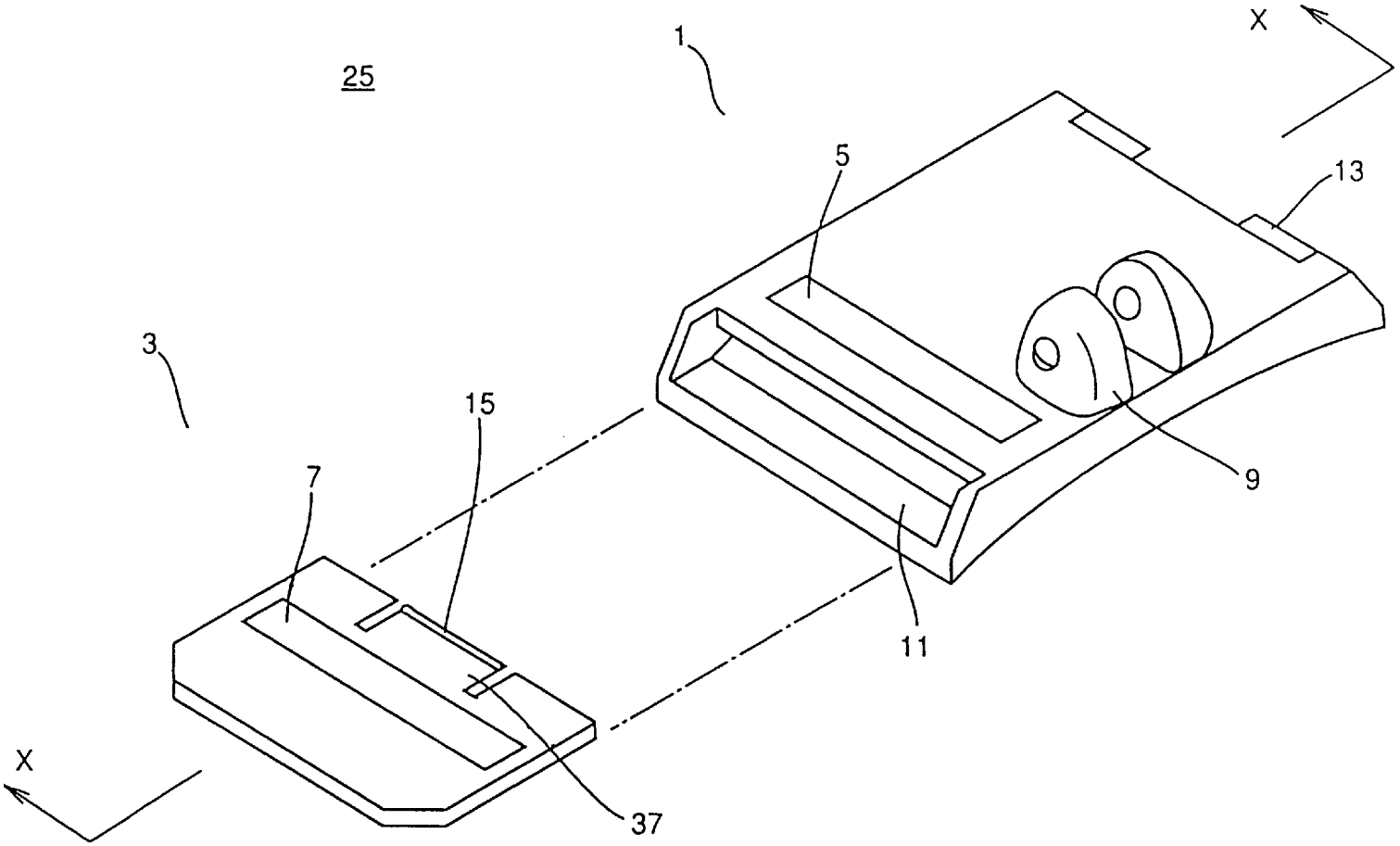
FIG. 1 is an exploded perspective view showing a structure of the attachment parts in accordance with one embodiment of the present invention.

FIG. 1 is an exploded perspective view showing the structure of attaching equipment 25 shown in FIG. 4.

Referring to the figure, the attaching equipment 25 consists of a first attachment part or bracket 1, and a second attachment part or spacer 3 detachably inserted to a spacer engaging slit or opening 11 provided at first end of bracket 1.

Bracket 1 includes a band engaging portion 13 which is engaged with first end of a band (not shown), a band inserting slit 5 allowing insertion and passage of the second end of the band, a spacer engaging slit 11 to which the spacer 3 is inserted, and an object engaging portion 9 which is engaged with an object, such as a head lamp to be attached.

Meanwhile, spacer 3 includes a band inserting slit 7 allowing insertion and passage of the second end of the band together with band inserting slit 5 while it is inserted to bracket 1, and a projecting portion 15 engageable with a projecting portion (not shown) of bracket 1 for preventing undesirable disengagement of spacer 3 from bracket 1. Projecting portion 15 is formed at an end portion of a cantilever spring 37 which is a part of spacer 3.

Figure 2A:
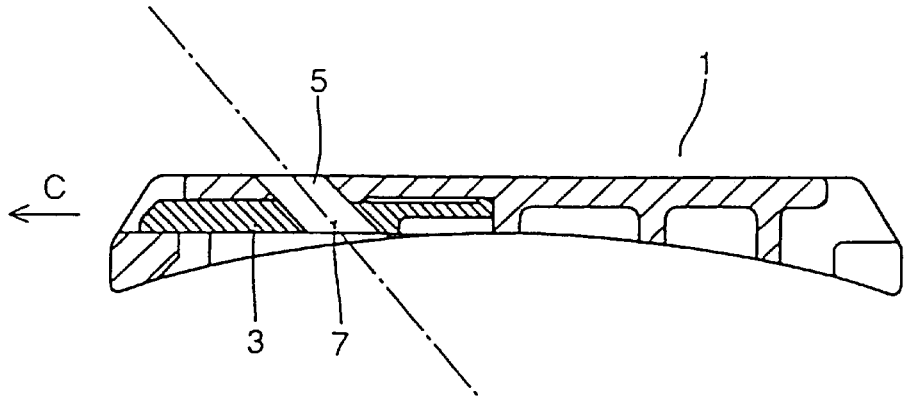
FIGS. 2A to 2C are cross sectional views taken along the line X—X where a bracket 1 and a spacer 3 of FIG. 1 are engaged.
Figure 2B:
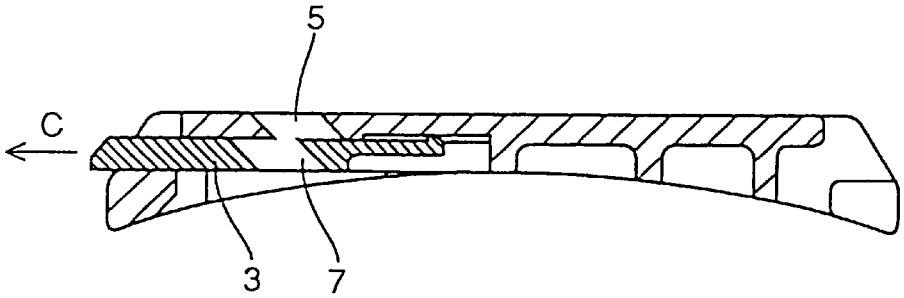
Figure 2C:
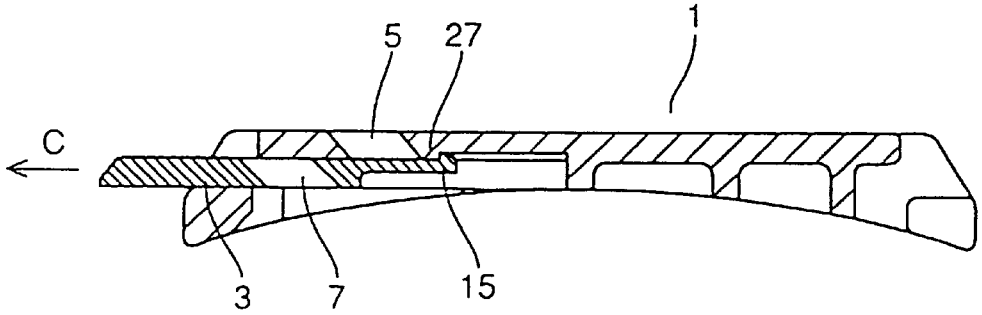

FIGS. 2A to 2C are cross sections taken along the line X—X with spacer 3 inserted into spacer engaging slit 11 of bracket 1 shown in FIG. 1.

Referring to FIG. 2A, the band inserting slit 5 of bracket 1 and band inserting slit 7 of spacer 3 are provided in the direction denoted by one dotted line, respectively. Band inserting slits 5 and 7 are adapted such that these are fully aligned with each other to allow insertion and passage of the band in the direction denoted by the one dotted line, when spacer 3 is fully inserted to bracket 1 as shown in FIG. 2A.

As spacer 3 moves in the direction of the arrow c from the state of FIG. 2A, relative positions of band inserting slits 5 and 7 are deviated as shown in FIG. 2B, so that band inserting slits 5 and 7 becomes less aligned with each other.

When spacer 3 further moves to the direction of the arrow c from the state of FIG. 2B to the state shown in FIG. 2C, projecting portion 27 of bracket 1 is engaged with projecting portion 15 of spacer 3, and hence further movement of spacer 3 to the direction of the arrow c is stopped. Thus undesirable disengagement of spacer 3 from bracket 1 can be prevented.

Figure 3A:
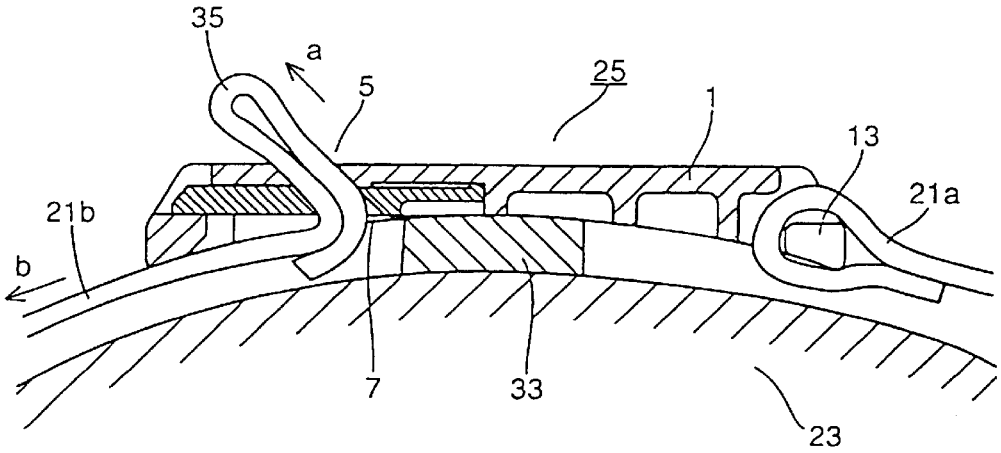
FIGS. 3A to 3C are cross sections showing how a band 21 is engaged with the attaching equipment 25.
Figure 3B:
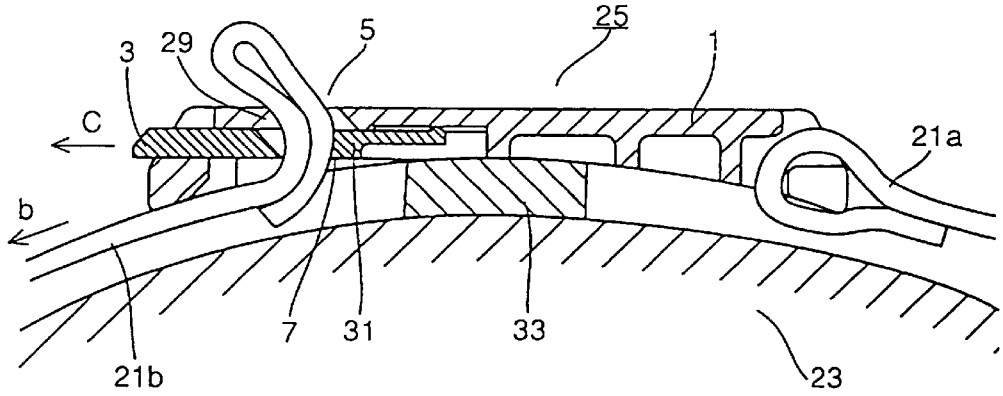
Figure 3C:
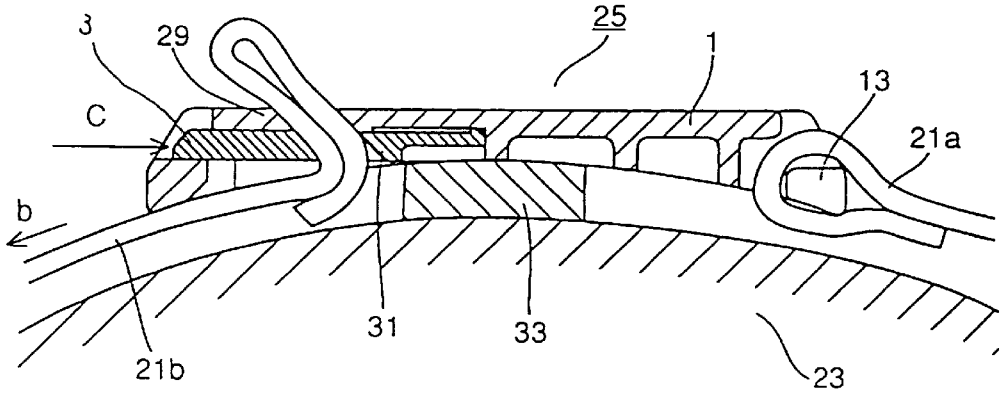

FIGS. 3A to 3C are cross sections taken along the line X—X showing how the first and second ends 21*a* and 21*b* of band 21 are attached to attaching equipment 25.

Referring to FIG. 3A, first end 21*a* of band 21 is formed as a loop. The hollow portion of the loop is engaged with band engaging portion 13, so that first end 21*a* of band 21 is secured on attaching equipment 25.

The second end 21*b* of band 21 is inserted to the slit consisting of band inserting slits 7 and 5, folded at portion 35. The second end 21*b* of band 21 is pulled in the direction of the arrow a manually, so that appropriate tension is applied to the band 21 which is formed of an elastic body.

Attaching equipment 25 is lined with rubber 33 on the surface facing helmet 23, and hence slip between attaching equipment 25 and helmet 23 can be prevented.

When one lets off the band from the state shown in FIG. 3A, there is generated a force in the direction of the arrow b in the second end 21*b* of band 21, because of the tension of band 21 which is an elastic body. Therefore, spacer 3 moves in the direction of the arrow c as shown in FIG. 3B. Then, a blade-like portion 29 which is a peripheral edge of band inserting slit 5 and a blade-like portion 31 which is a peripheral edge of band inserting slit 7 pinch band 21, whereby movement of the second end 21*b* of band 21 in the direction of the arrow b is prevented, and the second end 21*b* of band 21 is fixed on attaching equipment 25.

How to detach the second end 21*b* of band 21 from attaching equipment 25 will be described in the following.

When external force in the direction of the arrow c is applied to spacer 3 as shown in FIG. 3C, the state in which the second end 21*b* of band 21 is pinched by blade-like portions 29 and 31 is released, and the second end 21*b* of band 21 is allowed to freely move through the slit consisting of band inserting slits 5 and 7. In this state, the second end 21*b* of band 21 moves to the direction of the arrow b because of the tension of band 21, so that the second end 21*b* of band 21 is removed from attaching equipment 25.

Though a band has been described as an example of an object to be attached by the attaching equipment in the present embodiment, the present invention may be applied to any string-type object provided that it is flexible. Secure attachment is possible for a string having a circular cross section, for example, by adapting the shape of band inserting slits 5 and 7 to have corresponding circular shape.

In the present embodiment, the second end of the band is folded when it is inserted to the band inserting slits so that the extra portion of the band does not constitute an obstacle when the band is attached by the attaching equipment. However, the end portion of the band may not be folded. In that case, the width of band inserting slits 5 and 7 should be selected to fit the thickness of the band, so as to ensure secure attachment. Further, in place of rubber 33, small ups and downs or other slip preventing member may be provided with the attaching equipment 25 so as to prevent slip between the helmet and the attaching equipment.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An attaching equipment comprising in combination:

a elastic string-type object having one end attached to the attaching equipment and a free end;

a first attachment part having a substantially planar surface, a first slit of predetermined width allowing insertion and passage of said free end of said string-type object therethrough, said first slit formed at an acute angle to the planar surface of the first attachment part and having a blade-like portion provided at a peripheral edge;

a second attachment part having a substantially planar surface slidably engaging with said planar surface of said first attachment part and having a second slit of predetermined width fully aligned with said first slit at a prescribed engaging position, the predetermined width of the first slit being substantially the same as the predetermined width of the second slit, said second slit formed at an acute angle to said planar surface of the second attachment part and having a blade-like portion provided at a peripheral edge, the acute angle of the first slit coinciding with the acute angle of the second slit when the first and second slits are fully aligned, allowing insertion and passage of said free end of said string-type object therethrough; and wherein to fix the position of the string-type object with respect to the attaching equipment, the first and second attachment parts are slid relative to one another to move the first slit and the second slit relative to one another so that they become less aligned and the blade-like portions on the attachment parts pinch the string-type object to prevent the string-type object to be drawn out from the first and second slits.

2. The attaching equipment according to claim 1, wherein said first attachment part having an opening allowing insertion of said second attachment part, and said second attachment part is engaged with said first attachment part at said opening.

3. The attaching equipment according to claim 2, wherein each of said first and second attachment parts includes a projection portion for preventing disengagement from each other.

4. The attaching equipment according to claim 3, wherein said first attachment part includes an engaging portion to be engaged with said one end of said string-type object.

5. An attaching equipment according to claim 4, wherein said first attachment part includes an engaging portion adapted to be attached to an object to be supported.

6. An attaching equipment according to claim 5, wherein said string-type object is an elastic belt, and said object to be supported is a head lamp.

7. The attaching equipment according to claim 6, in combination with a helmet, wherein said first attachment part has a slip preventing member, said slip preventing member preventing, when said first attachment part is attached on said helmet with said string-type object wound around said helmet, slip between said helmet and said attaching equipment.

* * * * *